US010386757B2

(12) United States Patent
Okano

(10) Patent No.: US 10,386,757 B2
(45) Date of Patent: Aug. 20, 2019

(54) CLEANING APPARATUS, IMAGE FORMING APPARATUS, AND PROGRAM

(71) Applicant: KONICA MINOLTA, INC., Chiyoda-ku, Tokyo (JP)

(72) Inventor: Nobuhiko Okano, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/959,862

(22) Filed: Apr. 23, 2018

(65) Prior Publication Data

US 2018/0329338 A1 Nov. 15, 2018

(30) Foreign Application Priority Data

May 12, 2017 (JP) ..... 2017-095208

(51) Int. Cl.

| | |
|---|---|
| ***G03G 15/16*** | (2006.01) |
| ***G03G 21/00*** | (2006.01) |
| ***G03G 15/00*** | (2006.01) |

(52) U.S. Cl.

CPC ..... *G03G 15/168* (2013.01); *G03G 15/161* (2013.01); *G03G 15/50* (2013.01); *G03G 2215/1647* (2013.01); *G03G 2215/1661* (2013.01)

(58) Field of Classification Search

CPC ..... G03G 15/168

See application file for complete search history.

(56) References Cited

U.S. PATENT DOCUMENTS

| | | | | |
|---|---|---|---|---|
| 7,127,191 | B2 * | 10/2006 | Mori | G03G 15/166 399/101 |
| 2004/0213598 | A1 | 10/2004 | Mori | |
| 2015/0338785 | A1 * | 11/2015 | Ai | G03G 15/161 399/101 |

FOREIGN PATENT DOCUMENTS

| | | | |
|---|---|---|---|
| JP | 10-319735 | | 12/1998 |
| JP | 2007-279341 | A | 10/2007 |
| JP | 2007256868 | | 10/2007 |
| JP | 2013221951 | A * | 10/2013 |

OTHER PUBLICATIONS

Extended European Search Report issued in European Patent Application No. 18167472.2-1022, dated Oct. 2, 2018 (8 pages).

* cited by examiner

*Primary Examiner* — Clayton E. LaBalle
*Assistant Examiner* — Leon W Rhodes, Jr.
(74) *Attorney, Agent, or Firm* — Buchanan Ingersoll & Rooney PC

(57) ABSTRACT

A cleaning apparatus includes: a brush that contacts a transfer member and cleans and removes toner existing on the transfer member; a constant current type voltage applier that applies voltage to the brush; and a hardware processor that determines whether a condition that voltage exceeds a predetermined threshold is satisfied at a nip formed by the brush and the transfer member contacting each other, and controls the voltage by changing bias current of the voltage applier, wherein the transfer member has a sheet contact area contacting a sheet on the transfer member and an inter-sheet area other than the sheet contact area on the transfer member, and in a case where the hardware processor determines that the condition is satisfied, the hardware processor controls the voltage so as not to exceed the predetermined (Continued)

threshold by changing the bias current when the sheet contact area passes through the nip.

10 Claims, 11 Drawing Sheets

| | | CURRENT | HIGH HUMIDITY | NORMAL HUMIDITY | LOW HUMIDITY |
|---|---|---|---|---|---|
| TABLE 1 | INTER-SHEET AREA 5n | A11 | +10 μA | +10 μA | +10 μA |
| | | A21 | −10 μA | −10 μA | −10 μA |
| | SHEET CONTACT AREA 5p | A12 | +10 μA | +10 μA | +10 μA |
| | | A22 | −10 μA | −10 μA | −10 μA |
| TABLE 2 | INTER-SHEET AREA 5n | A11 | +10 μA | +10 μA | +10 μA |
| | | A21 | −10 μA | −10 μA | −10 μA |
| | SHEET CONTACT AREA 5p | A12 | +10 μA | +12 μA | +14 μA |
| | | A22 | −10 μA | −8 μA | −6 μA |

CLEANING APPARATUS, IMAGE FORMING APPARATUS, AND PROGRAM

The entire disclosure of Japanese patent Application No. 2017-095208, filed on May 12, 2017, is incorporated herein by reference in its entirety.

BACKGROUND

Technological Field

The present invention relates to a cleaning apparatus, an image forming apparatus, and a program.

Description of the Related Art

In the related art, there is a known image forming apparatus that forms an image on a sheet by transferring and fixing a toner image formed on an image bearer such as a photoreceptor onto a sheet placed on a transfer member such as a transfer belt.

A toner image is transferred onto a sheet by: applying, to the transfer member, transfer voltage having a polarity (positive) opposite to a normal charge polarity (negative here) of toner; and transferring the toner image formed on the image bearer to the sheet side. The sheet to which the toner image has been transferred is conveyed to a fixing device, and the toner image is fixed on the sheet by the fixing device.

In the above-described image forming apparatus, there is a case where the toner adheres onto the transfer member on a downstream side of a transfer position formed between the transfer member and the image bearer in a rotational direction of the transfer member. When this adhering toner reaches the transfer position again by rotation of the transfer member, the adhering toner may be moved to a sheet and toner stain may be caused.

To avoid such a situation, in the related art, a cleaning apparatus that cleans and removes toner existing on a transfer member is provided on a downstream side of a transfer position in a rotational direction of the transfer member. The cleaning apparatus has a brush that can be rotated while contacting the transfer member, and electrostatically removes residual toner existing on the transfer member by applying, to the brush, cleaning bias having a polarity (positive) opposite to that of the toner.

However, separation discharge may be caused when the sheet is separated from the transfer member. With this separation discharge, negative charge is moved to the transfer member side and positive charge is moved to the sheet side by this separation discharge. Then, a potential difference between the transfer member and the positively-charged brush becomes too large, and excessive current may flow, thereby charging the toner to have the opposite polarity. As a result, cleaning efficiency by the brush may be degraded.

To solve the above-described problem, the invention in JP 2007-279341 A discloses a technology in which static charge eliminating members are disposed on both of a downstream side of a transfer position and an upstream side of a cleaning apparatus respectively to eliminate negative charge that has been moved to the transfer member. With this structure, a potential of the transfer member is prevented from becoming too large on the negative side.

However, according to a structure disclosed in JP 2007-279341 A, static charge eliminating members are needed to be newly disposed in an existing structure, thereby causing cost increase. Additionally, since it is necessary to secure a space to dispose the static charge eliminating members, upsizing of a device and arrangement change of other members may be necessary.

SUMMARY

The present invention has been made in view of the above-described problems, and an object thereof is to provide a cleaning apparatus, an image forming apparatus, and a program in which toner on a transfer member can be cleaned at low cost without affecting an existing structure.

To achieve the abovementioned object, according to an aspect of the present invention, a cleaning apparatus reflecting one aspect of the present invention comprises:

a brush that contacts a transfer member and cleans and removes toner existing on the transfer member;

a constant current type voltage applier that applies voltage to the brush; and a hardware processor that determines whether a condition that voltage applied to the brush exceeds a predetermined threshold is satisfied at a nip formed by the brush and the transfer member contacting each other, and controls the voltage applied to the brush by changing bias current of the voltage applier, wherein the transfer member has a sheet contact area contacting a sheet on the transfer member and an inter-sheet area other than the sheet contact area on the transfer member, and in a case where the hardware processor determines that the condition that the voltage applied to the brush exceeds the predetermined threshold is satisfied, the hardware processor controls the voltage applied to the brush so as not to exceed the predetermined threshold by changing the bias current when the sheet contact area passes through the nip.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

In the following, an image forming apparatus according to a first embodiment of the present invention will be described with reference to the drawings. Note that the description will be provided by exemplifying a monochrome image forming apparatus in the embodiment of the present invention, but the present invention is not limited thereto and is also applicable to, for example, a color image forming apparatus.

(1) Structure of Image Forming Apparatus

Figure 1:
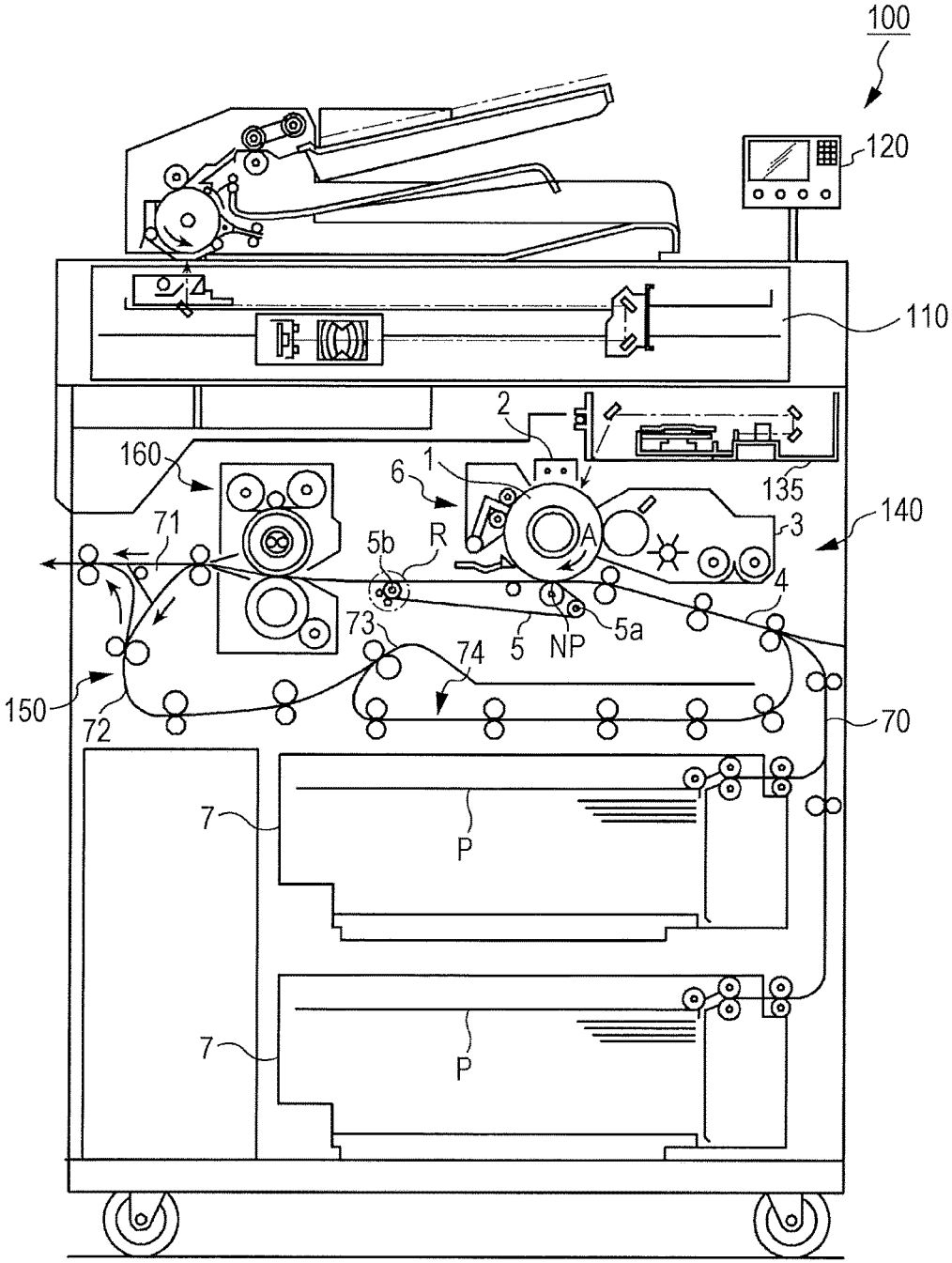
FIG. 1 is a diagram illustrating a schematic structure of an image forming apparatus according to an embodiment of the present invention.
Figure 2:
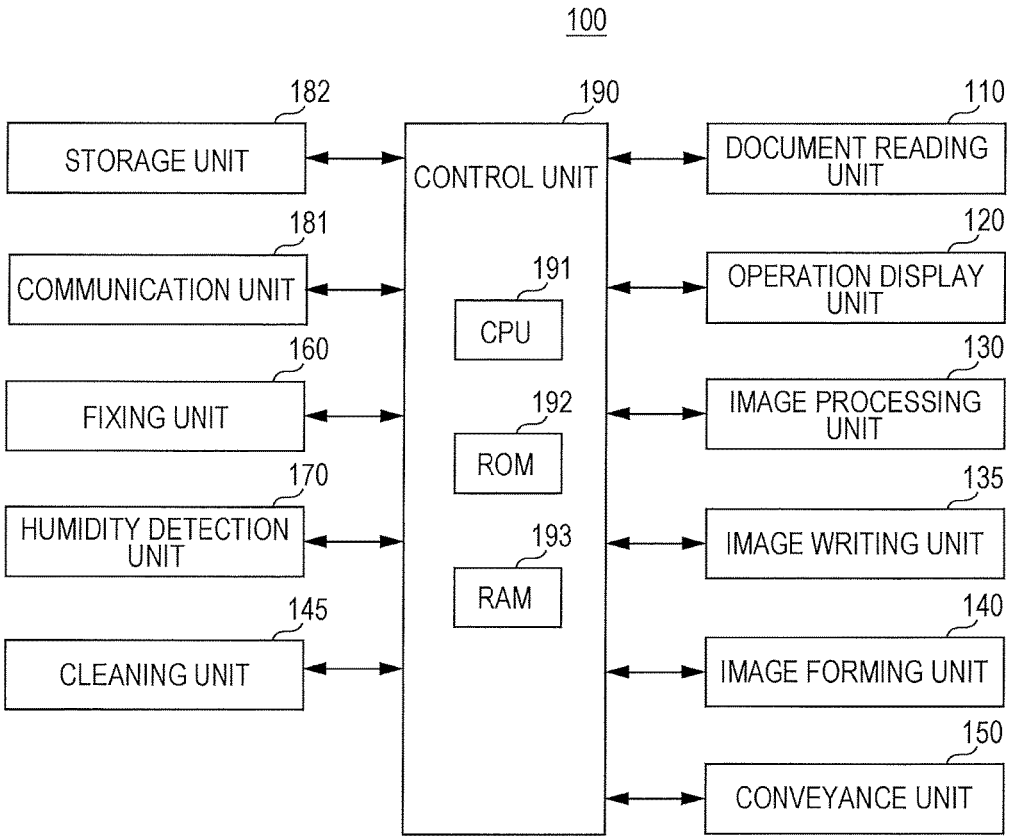
FIG. 2 is a block diagram illustrating functional components of the image forming apparatus according to an embodiment of the present invention.

FIG. 1 is a diagram illustrating a schematic structure of an image forming apparatus 100, and FIG. 2 is a block diagram illustrating main functional components of the image forming apparatus 100. The image forming apparatus 100 forms an image on a sheet by an electrophotographic process.

As illustrated in FIGS. 1 and 2, the image forming apparatus 100 includes a document reading unit 110, an operation display unit 120, an image processing unit 130, an image writing unit 135, an image forming unit 140, a cleaning unit 145, a conveyance unit 150, a fixing unit 160, a humidity detection unit 170, a communication unit 181, a storage unit 182, and a control unit 190.

The control unit 190 includes a central processing unit (CPU) 191, a read only memory (ROM) 192, a random access memory (RAM) 193, and the like.

The CPU 191 reads a program corresponding to processing content from the ROM 192, develops the program in the RAM 193, and control operation of each block of the image forming apparatus 100 in cooperation with the developed program. At this point, various kinds of data stored in the storage unit 182 are referred to. The storage unit 182 includes, for example, a nonvolatile semiconductor memory (so-called flash memory) and a hard disk drive.

The control unit 190 exchanges various kinds of data with an external device (personal computer, for example) connected to a communication network such as local area network (LAN) and a wide area network (WAN) via the communication unit 181. For example, the control unit 190 receives image data transmitted from the external device and forms an image on a sheet on the basis of the received image data. The communication unit 181 includes a communication control card such as a LAN card.

The document reading unit 110 optically scans a document conveyed onto a contact glass, forms an image of reflected light received from the document on a light receiving surface of a charge coupled device (CCD) sensor, and reads the document. Note that the document is conveyed onto the contact glass by an automatic document feeder (ADF), but a document may also be manually placed on the contact glass.

The operation display unit 120 has a touch panel screen. Various commands made by the user and inputting operation for setting can be performed by using this touch panel screen. These commands and setting information are handled as job information by the control unit 190. The job information includes, for example, a sheet size, the number of prints, and the like.

The image processing unit 130 includes: a circuit that performs analog-digital (A/D) conversion processing; and a circuit that performs digital image processing. The image processing unit 130 generates, by A/D conversion processing, digital image data from an analog image signal acquired by a CCD sensor of the document reading unit 110, and outputs the digital image data to the image writing unit 135.

The image forming unit 140 has a photoreceptor drum 1 and is provided with, in a rotational direction of this photoreceptor drum 1 (direction of an arrow A): a charging device 2; the image writing unit 135; a developing device 3; a transfer conveyance path 4 that guides a sheet P to a transfer region; a transfer belt 5 (transfer member) that transfers a toner image formed on the photoreceptor drum 1 to the sheet P; and a cleaner unit 6 that removes toner remaining on the photoreceptor drum 1.

The image writing unit 135 emits laser light on the basis of digital image data generated by the image processing unit 130 and irradiates the photoreceptor drum 1 of the image forming unit 140 with the emitted laser light, thereby forming an electrostatic latent image on the photoreceptor drum 1 (exposure step).

In addition to the above-described exposure step, the image forming unit 140 executes: a charging step performed before the exposure step; a development step after the exposure step; a transfer step after the development step; a photoreceptor cleaning step after the transfer step; and a belt cleaning step, respectively. In the charging step, the image forming unit 140 uniformly charges a surface of the photoreceptor drum 1 by corona discharge from the charging device 2. In the development step, the image forming unit 140 forms a toner image on the photoreceptor drum 1 by making a toner contained in developer inside the developing device 3 adhere to the electrostatic latent image on the photoreceptor drum 1.

In the transfer step, the image forming unit 140 transfers the toner image formed on the photoreceptor drum 1 onto a sheet conveyed by the conveyance unit 150 via the transfer belt 5 by applying transfer voltage by a voltage application device (not illustrated).

The transfer belt 5 is stretched around a driven roller 5*a*, a drive roller 5*b*, and another roller, and arranged such that a surface of the transfer belt 5 contacts a part of an outer peripheral surface of the photoreceptor drum 1 on a lower side of the photoreceptor drum 1. In other words, a nip NP functioning as a transfer region is formed between the transfer belt 5 and the photoreceptor drum 1. The sheet P is conveyed while being pressed against the photoreceptor drum 1 by the transfer belt 5 at the nip NP.

In the following, a region in a rotational direction of the transfer belt 5 where the sheet P and the transfer belt 5 contact each other will be defined as a sheet contact area 5*p*, and a region of the transfer belt 5 where the sheet P and the transfer belt 5 do not contact each other will be defined as an inter-sheet area 5*n*.

In the photoconductor cleaning step, a cleaning member such as a brush is made to contact the photoreceptor drum 1 in the cleaner unit 6, thereby the image forming unit 140 removing the toner remaining on the photoreceptor drum 1 after the transfer step.

In the belt cleaning step, the image forming unit 140 performs cleaning for the transfer belt 5 by using a cleaning apparatus including the cleaning unit 145 and the control unit 190.

Figure 3:
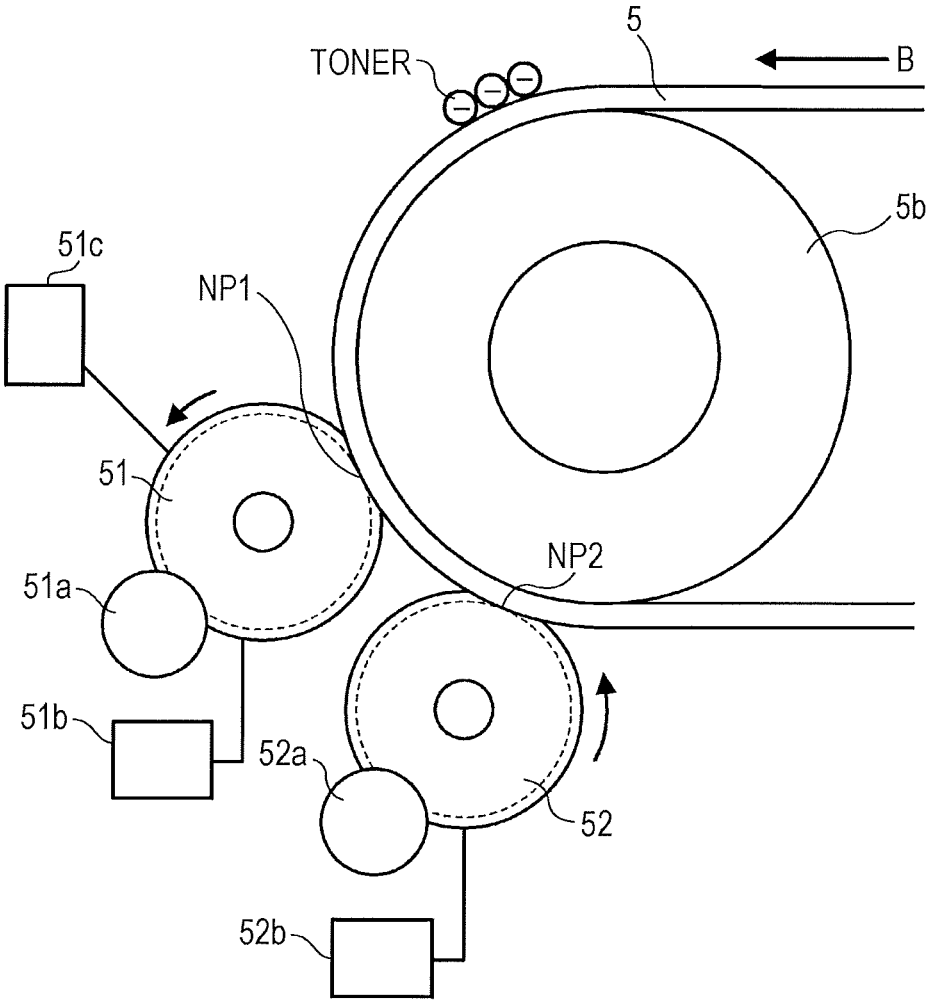
FIG. 3 is an enlarged view illustrating a region R in FIG. 1.

As illustrated in FIG. 3, the cleaning unit 145 includes a main brush 51, a metal roller 51*a*, a high-voltage power source 51*b*, a voltage measuring unit 51*c*, a sub-brush 52, a metal roller 52*a*, and a high-voltage power source 52*b*, and removes toner that adheres onto the transfer belt 5.

The fixing unit 160 includes a fixing roller and a pressure roller. The pressure roller is arranged in a state pressed against the fixing roller. A fixing nip portion is formed at a press contact portion between the fixing roller and the pressure roller. The fixing unit 160 fixes a toner image on a sheet (fixing step) by applying heat and pressure to the toner image (thermal fixing) to the sheet that has been introduced to the fixing nip portion. As a result, a fixed toner image is formed on the sheet. The sheet subjected to thermal fixing by the fixing unit 160 is ejected to the outside of the image forming apparatus 100.

The humidity detection unit 170 is disposed inside the image forming apparatus 100, and detects internal humidity of the image forming apparatus 100. The control unit 190 acquires a detection result acquired by the humidity detection unit 170.

A sheet P is stored in the sheet feeding cassette 7 and supplied to the transfer conveyance path 4 through a sheet feeding conveyance path 70. A gate 71 is provided on a downstream side of the fixing unit 160 and performs switching between a case of ejecting the sheet P to the outside and a case of feeding the sheet P to a double-sided conveyance path 72 for double-sided printing. The sheet P having entered the double-sided conveyance path 72 once advances to a reverse conveyance path 73 to be reversed here, and joins the transfer conveyance path 4 from a refeeding transfer conveyance path 74.

(2) Cleaning Apparatus

In the following, the cleaning apparatus will be described in detail.

The main brush 51 is made of, for example, nylon, polyester, or the like, and is arranged on a downstream side of the transfer position (nip NP) for a sheet P in the rotational direction of the transfer belt 5.

The main brush 51 forms a nip NP1 with the transfer belt 5 by pile of the brush biting into the transfer belt 5, and a surface of the main brush 51 at the main brush nip NP1 is driven so as to be rotated in a direction opposite to (counter direction of) the rotational direction of the transfer belt 5. Cleaning bias current A1 having positive polarity is applied to the main brush 51 by the constant current type high-voltage power source 51*b* (voltage applier). As a result, a toner image having a negative polarity (such as a density control patch or a testing zone) formed in the inter-sheet area 5*n* on the transfer belt 5 is attracted, and the transfer belt 5 is cleaned.

Additionally, the metal roller 51*a* is made to contact the main brush 51 in a manner biting into the main brush 51 such that the toner adhering to the main brush 51 can be removed. The metal roller 51*a* is made of, for example, aluminum or the like.

Furthermore, a voltage measuring unit 51*c* (voltage measurer) is connected to the main brush 51, and the voltage measuring unit 51*c* measures voltage applied to the main brush 51.

Here, transfer voltage having a predetermined value and a positive polarity is applied to the sheet contact area 5*p* of the transfer belt 5 at the nip NP, thereby injecting positive charge into the transfer belt 5. Consequently, a toner image having a negative polarity on the photoreceptor drum 1 is transferred onto the sheet P that is currently contacting the photoreceptor drum 1. Additionally, the sheet P can be electrostatically attracted to and conveyed by the transfer belt 5 by this transfer voltage applied during this time.

In contrast, transfer voltage having a predetermined value and a negative polarity is applied to the inter-sheet area 5*n* of the transfer belt 5 at the nip NP. Since negative charge is injected into the inter-sheet area 5*n* of the transfer belt 5 by this transfer voltage application, repulsive force is generated between the transfer belt 5 and the toner having the negative polarity and existing on the inter-sheet area 5*n*, and the toner can be easily recovered by the main brush 51.

Similar to the main brush 51, the sub-brush 52 is formed of nylon, polyester, or the like, and is installed on the downstream side of the main brush 51 in the rotational direction of the transfer belt 5. The sub-brush 52 is rotated in the counter direction of the rotational direction of the transfer belt 5 and the pile of the sub-brush bites into the transfer belt 5, thereby forming a sub-brush nip NP2. Cleaning bias current A2 is applied to the sub-brush 52 by the high-voltage power source 52*b*, and cleans positively-charged toner that has not been removed by the main brush 51 and remained on the inter-sheet area 5*n*.

Additionally, the metal roller 52*a* is also made to contact the sub-brush 52 in a manner biting into the sub-brush 52, and toner adhering to the sub-brush 52 is removed. Similar to the metal roller 51*a*, the metal roller 52*a* is made of aluminum or the like.

Meanwhile, cleaning performance during image forming can be improved by providing the sub-brush 52, but a structure not provided with the sub-brush 52 is also applicable.

(3) Potential Change

Figure 4A:
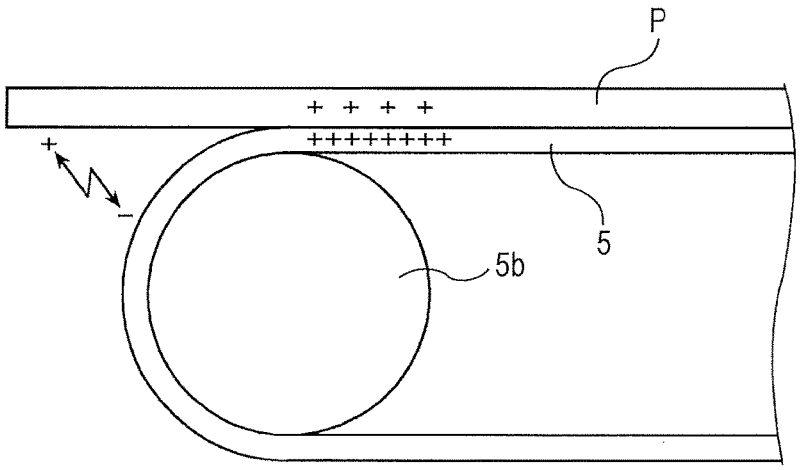
FIGS. 4A and 4B are diagrams to describe a general idea of separation discharge.

Next, potential change in the transfer belt 5 and the main brush 51 during image forming will be described with reference to FIGS. 4A and 4B.

As described above, a sheet P is attracted and conveyed on the transfer belt 5 by applying the transfer voltage having a predetermined value and a positive polarity to sheet contact area 5*p*, but separation discharge may be caused when the sheet P is separated from the transfer belt 5. When the separation discharge is caused, negative charge is moved to the transfer belt 5 having a high potential on the positive side, and positive charge is moved to the sheet P as illustrated in FIG. 4A. When resistance of the transfer belt 5 is high, electric charge is hardly released, and therefore, the negative charge is accumulated on the transfer belt 5.

Figure 4B:
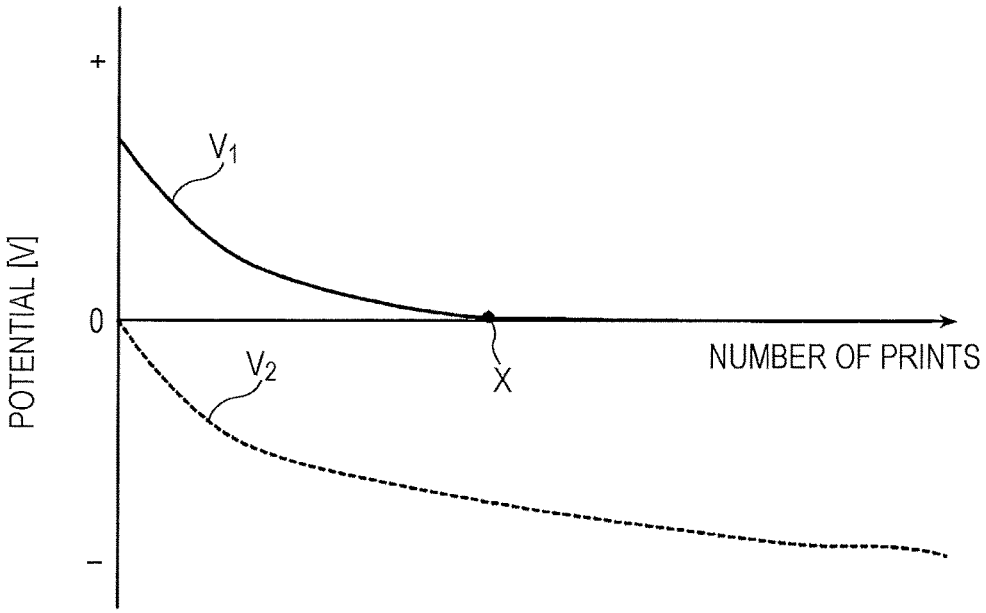

Here, since the cleaning bias current A1 having the positive polarity is applied to the main brush 51 as described above, a potential V1 of the main brush 51 is on the positive side, but as illustrated in FIG. 4B, when a potential V2 of the transfer belt 5 is lowered due to separation discharge, the potential V1 of the main brush 51 is lowered in order to keep a constant potential difference from that of the transfer belt 5.

However, when the potential V1 of the main brush 51 reaches an output lower limit value (position X in FIGS. 5A and 5B) of the high-voltage power source 51*b* that applies voltage to the main brush 51, the potential V1 is not lowered any further. Therefore, since the potential difference between the main brush 51 and the transfer belt 5 is increased thereafter, a current amount flowing between the main brush 51 and the transfer belt 5 is increased, and the toner on the inter-sheet area 5*n* is positively charged. When the toner is positively charged, the toner can be hardly recovered by the main brush 51, and cleaning efficiency is degraded. As a result, the toner on the transfer belt 5 is moved to the sheet, and toner stain or the like is caused.

Therefore, in the present embodiment, the potential V1 of the main brush 51 is increased on the positive side, thereby preventing the potential difference between the main brush 51 and the transfer belt 5 from being too large. In other words, the potential V1 of the main brush 51 is increased on the positive side by controlling the cleaning bias current A1 applied to the main brush 51, and the potential difference from that of the transfer belt 5 can be kept constant by controlling the potential V1 so as not to reach the output lower limit value of the high-voltage power source 51*b*.

Meanwhile, a value of the cleaning bias current applied to the inter-sheet area 5*n* is needed to be kept constant during image forming in order to perform proper toner cleaning in the inter-sheet area 5*n*. Therefore, the potential V1 of the main brush 51 is controlled by changing only the cleaning bias current applied to the sheet contact area 5*p*.

A control method for the cleaning bias current applied to the main brush 51 and potential change in the transfer belt 5 and the main brush 51 will be described with reference to FIGS. 5A, 5B and 6.

Figure 5A:
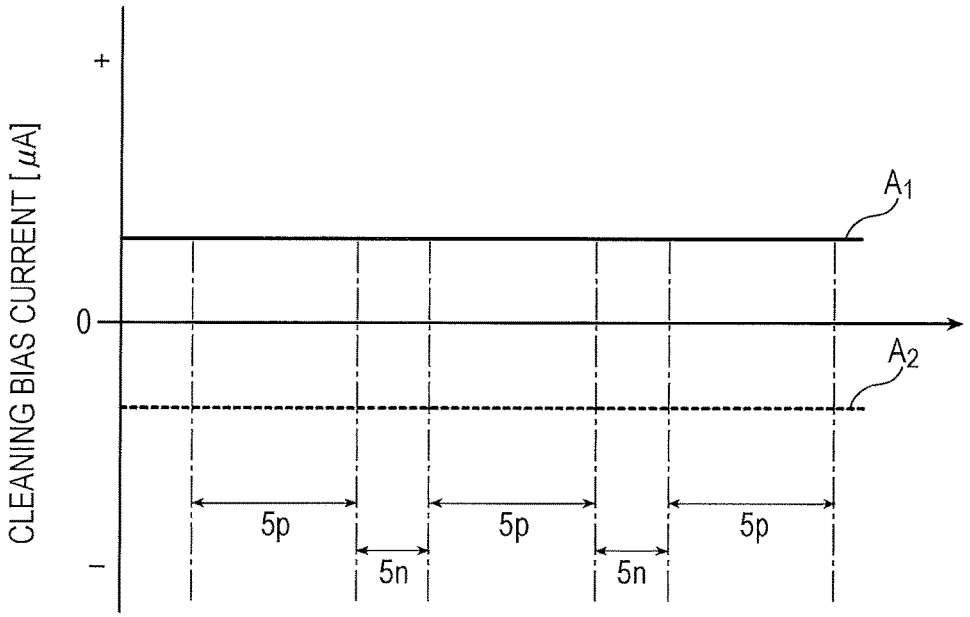
FIGS. 5A and 5B are diagrams to describe control for cleaning bias current according to an embodiment of the present invention.

As illustrated in FIG. 5A, in an image forming apparatus in the related art, constant cleaning bias current A1 and constant cleaning bias current A2 are constantly applied to a main brush 51 and a sub-brush 52, respectively.

Figure 5B:
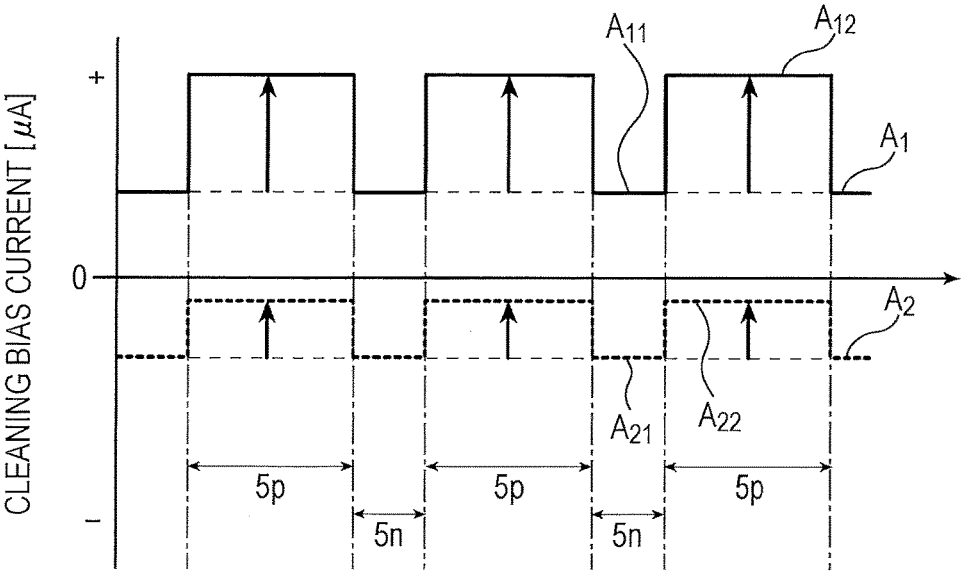
Figure 6:
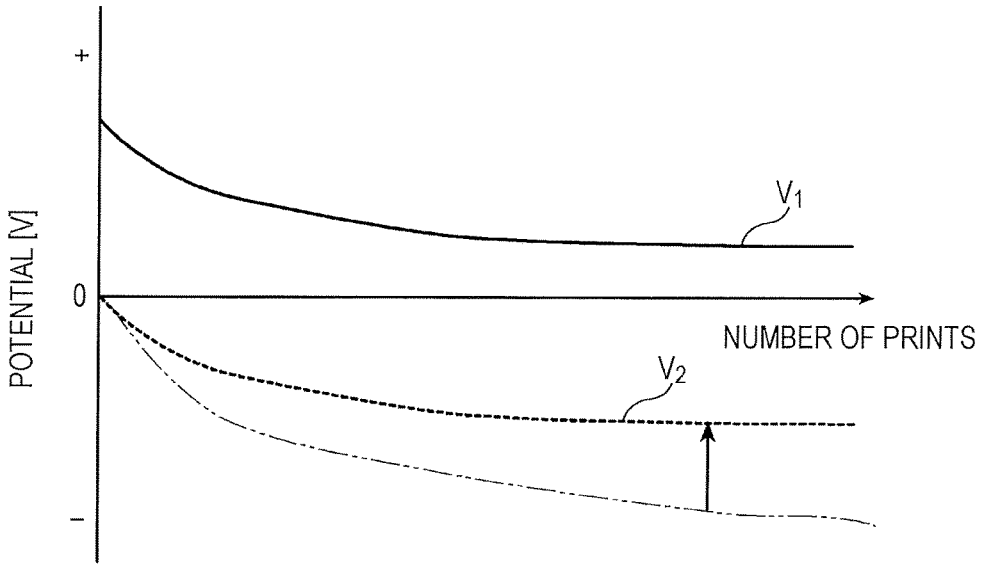
FIG. 6 is a diagram illustrating potentials of a main brush and a transfer belt according to an embodiment of the present invention.

In contrast, in the present embodiment, cleaning bias current A12 applied to the sheet contact area 5*p* is increased on the positive side while cleaning bias current A11 applied to the inter-sheet area 5*n* is kept constant as illustrated in FIG. 5B With this control, the potential V1 of the main brush 51 can be increased on the positive side, and the potential V2 of the transfer belt 5 can be suppressed from becoming too large on the negative side by moving negative charge on the transfer belt 5 to the main brush 51 as illustrated in FIG. 6. Therefore, the potential difference between the transfer belt 5 and the main brush 51 can be kept constant, and occurrence of cleaning failure can be suppressed.

Additionally, as illustrated in FIG. 5B, the potential V2 of the transfer belt 5 can be more efficiently controlled by reducing, on the negative side, cleaning bias current A22 of the sub-brush 52 applied to the sheet contact area 5*p* while keeping constant cleaning bias current A21 of the sub-brush 52 applied to the inter-sheet area 5*n*.

(4) Operation of Image forming Apparatus

Figure 7:
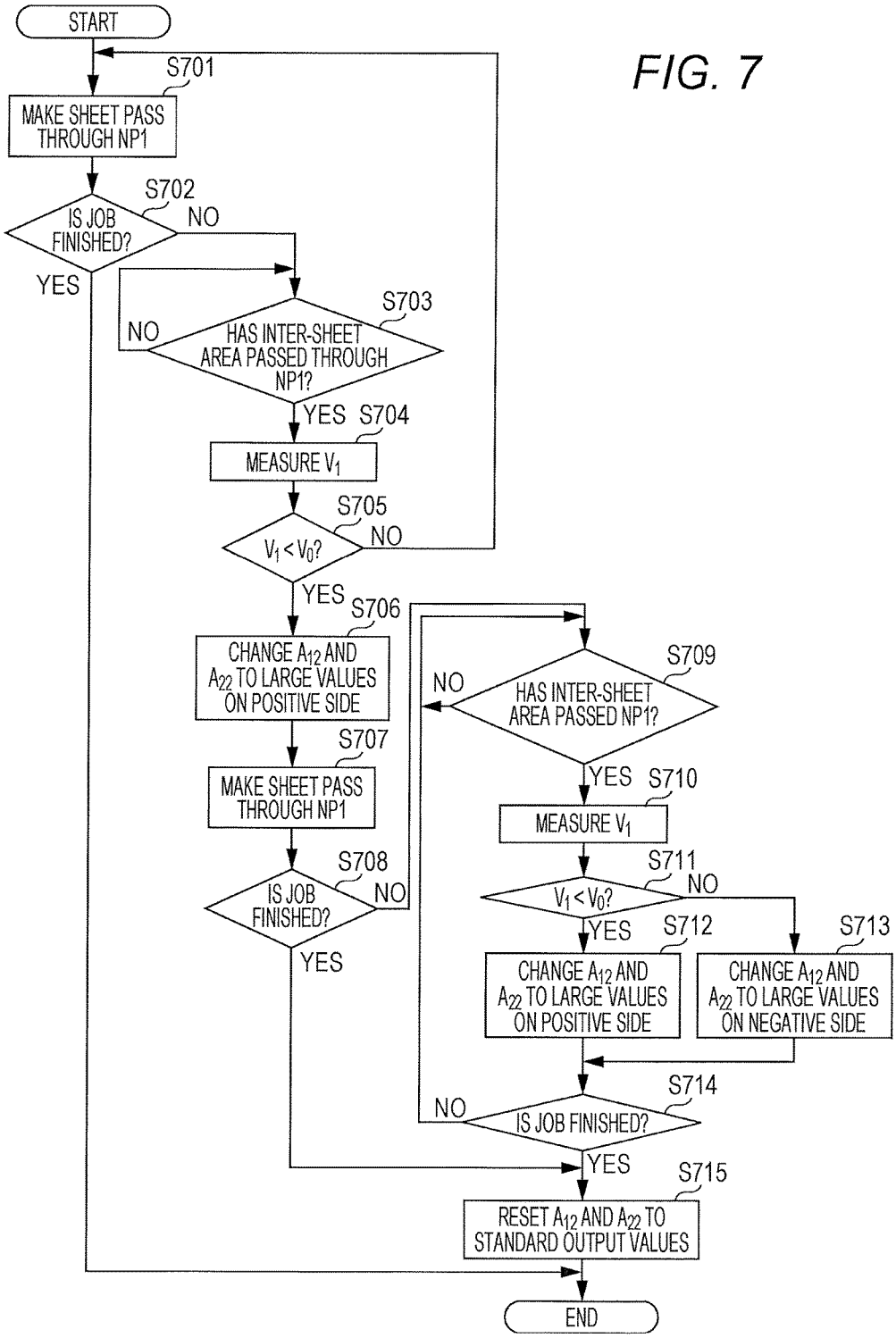
FIG. 7 is a flowchart illustrating operation of an image forming apparatus according to a first embodiment.

Next, operation of the image forming apparatus 100 according to a first embodiment will be described with reference to the flowchart of FIG. 7. Note that operation of the image forming apparatus 100 in FIG. 7 is executed in cooperation of the control unit 190 and a program stored in the storage unit 182.

When a job is started, the control unit 190 starts image forming, and a sheet is made to pass through the main brush nip NP1 (step S701).

Next, the control unit 190 determines whether the job is finished (step S702), and in a case of determining that the job is finished (step S702: Yes), control is finished, but in a case of determining that the job is not finished (Step S702: No), processing proceeds to step S703.

In step S703, the control unit 190 determines whether the inter-sheet area 5*n* has passed through the main brush nip NP1, and in a case of determining that the inter-sheet area 5*n* has not yet passed through the main brush nip NP1 (step S703: No), the processing of step S703 is repeated, but in a case of determining that the inter-sheet area has passed the main brush nip NP1 (step S703: Yes), a potential V1 of the main brush 51 during passage of the inter-sheet area 5*n* is measured (step S704).

Next, the control unit 190 (determiner) determines whether the potential V1 measured in step S704 is lower than a predetermined threshold V0 (whether potential V1 exceeds a predetermined threshold) (step S705). Here, the predetermined threshold V0 is a value preliminarily set and stored in the storage unit 182, and also is a value higher than voltage on the positive side and higher than the output lower limit value of the high-voltage power source 51*b*.

In a case where the control unit 190 determines that the potential V1 is not lower than the threshold V0 (does not exceed the predetermined threshold), that is, V1≥V0 (step S705: No), the processing returns to step S701. In a case where the control unit 190 determines that the potential V1 is lower than the threshold V0 (exceeds the predetermined threshold), that is, V1≤V0 (step S705: Yes), the processing proceeds to step S706.

In step S706, the control unit 190 (controller) sets, for the sheet contact area 5*p*, the cleaning bias current A12 applied to the main brush 51 and the cleaning bias current A22 applied to the sub-brush 52 to large values on the positive side (the cleaning bias current A22 is changed to a small value on the negative side). In this case, the values of the cleaning bias current A12 and A22 are arbitrary values preliminarily set and stored in the storage unit 182.

Next, the control unit 190 makes the sheet pass through the main brush nip NP1 (step S707), and determines whether the job is finished (step S708). In a case where the control unit 190 determines that the job is finished (step S708: Yes), the processing proceeds to step S715, but in a case of determining that the job is not finished (step S708: No), the processing proceeds to step S709.

Since the processing in steps S709 to S711 is similar to the processing in steps S703 to S705, the description thereof will be omitted.

In step S711, in a case of determining that V1<V0 (step S711: Yes) is satisfied, the control unit 190 (controller) changes, for the sheet contact area 5*p*, the cleaning bias current A12 applied to the main brush 51 and the cleaning bias current A22 applied to the sub-brush 52 to large values on the positive side (cleaning bias current A22 is changed to a small value on the negative side) (step S712), and the processing proceeds to step S714.

In step S711, in a case where the control unit 190 (controller) determines that V1≥V0 is satisfied (step S711: No), the control unit 190 (controller) changes, for the sheet contact area 5*p*, the cleaning bias current A12 applied to the main brush 51 and the cleaning bias current A22 applied to the sub-brush 52 to large values on the negative side (cleaning bias current A12 is changed to a value close to zero) (step S713), and the processing proceeds to step S714.

Subsequently, in step S714, the control unit 190 determines whether the job is finished. In a case where the control unit 190 determines that the job is not finished (step S714: No), the processing returns to step S709 and repeats the above-described processing. In a case of determining that the job is finished (step S714: Yes), the control unit 190 resets the cleaning bias current A12 and A22 to standard output values at the time of starting a job (step S715), and finishes the control.

Figures 8, 9:
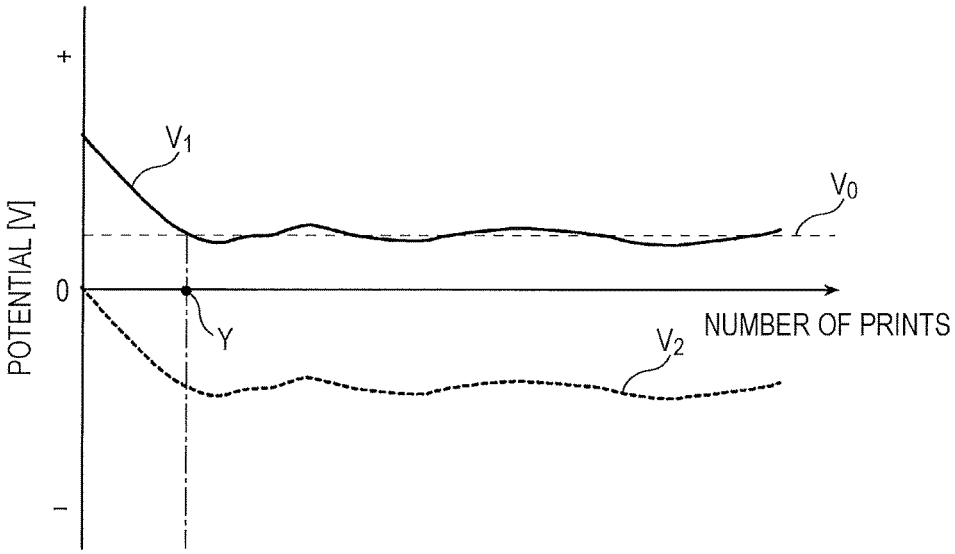
FIG. 8 is a view to describe potentials of a main brush and a transfer belt according to the first embodiment.
FIG. 9 is a diagram illustrating an exemplary control table for cleaning bias current according to a second embodiment.

FIG. 8 illustrates exemplary potential change of the transfer belt 5 and the main brush 51 in a case of performing the above-described control.

As illustrated in FIG. 8, the control is started when the potential V1 of the main brush 51 becomes lower than the threshold V0 (position Y in FIG. 8), and after that, every time the potential V1 becomes higher or lower than the threshold V0, the potential V1 is controlled to be a value close to the threshold V0 by changing the cleaning bias current applied to the sheet contact area 5*p*. With this control, the potential V2 of the transfer belt 5 is also kept at a substantially constant value.

As described above, in the image forming apparatus 100 according to the first embodiment, the potential V1 of the main brush 51 is measured, and in the case where the potential V1 is lower than the predetermined threshold V0 preliminarily set, the potential V1 is controlled so as to exceed the threshold V0 by increasing the cleaning bias current of the main brush 51 on the positive side. Therefore, the inter-sheet area 5*n* can be controlled so as to have a value not lower than the predetermined threshold V0, and as a result, the potential difference from that of the transfer belt 5 can be kept constant and cleaning failure can be prevented.

Additionally, in the image forming apparatus 100 according to the first embodiment, the potential V1 is measured when the inter-sheet area 5*n* on the transfer belt 5 passes through the main brush nip portion NP1 formed between the transfer belt 5 and the main brush 51. In other words, since the potential is measured in the region where the value of the cleaning bias current to be applied is not changed, accuracy of potential control can be improved.

Additionally, in the image forming apparatus 100 according to the first embodiment, since the cleaning bias current A12 and A22 applied to the main brush 51 and the sub-brush 52 respectively are set to large values on the positive side that is the opposite polarity of the normal charge polarity of toner, the potential V1 of the main brush 51 is controlled so as to exceed the threshold V0. Therefore, since the above-described control can be performed by using an existing structure without adding a new component such as a static charge eliminating member, the above control can be achieved with a reduced space at a low cost Furthermore, in the image forming apparatus 100 according to the first embodiment, the cleaning bias current A11 and cleaning bias current A21 applied to the inter-sheet area 5*n* to which toner to be removed adheres are kept constant, and only the cleaning bias current A12 and cleaning bias current A22 applied to the sheet contact area 5*p* are changed. With this control, the effects of the present invention can be obtained without affecting toner cleaning for the inter-sheet area 5*n*.

Additionally, in the image forming apparatus 100 according to the first embodiment, the potential V1 of the main brush 51 is measured for each inter-sheet area 5*n*. Furthermore, in a case where the potential V1 exceeds the threshold V0, the cleaning bias current applied to each of the main brush 51 and the sub-brush 52 is increased on the negative side such that the potential V1 of the main brush 51 is lowered. Therefore, the potential V1 of the main brush 51 can be controlled so as to constantly have a value close to the threshold V0, and as a result, the potential V2 of the transfer belt 5 can be kept constant. Consequently, the transfer belt 5 can be stably cleaned.

Second Embodiment

Subsequently, an image forming apparatus according to a second embodiment of the present invention will be described with reference to the drawings. The image forming apparatus according to the second embodiment differs from a first embodiment in that a potential of a main brush is controlled in accordance with sheet information and environmental conditions.

Note that a detailed description of components similar to those of the first embodiment will be omitted by using the same reference signs.

A separation discharge amount of a sheet is largely influenced by electric characteristics of the sheet. For example, the higher resistance a sheet has like a coated paper, a label paper, a thick paper, and the like, the larger the separation discharge amount is. When the separation discharge amount is large, a potential V2 of a transfer belt 5 is largely charged on a negative side, and therefore, a potential V1 of a main brush 51 is also lowered along with this negative charge.

Therefore, the image forming apparatus 100 according to the second embodiment controls cleaning bias current applied to each of the main brush 51 and a sub-brush 52 in accordance with a sheet type.

The separation discharge amount of a sheet is also largely influenced by environmental conditions. Particularly, the separation discharge amount is increased under a low humidity condition, and therefore, the image forming apparatus 100 according to the second embodiment controls the cleaning bias current applied to each of the main brush 51 and the sub-brush 52 in accordance with the humidity.

FIG. 9 illustrates a bias control table for the main brush 51.

Table 1 illustrated in FIG. 9 is a table that provides values of cleaning bias current applied to each of the main brush 51 and the sub-brush 52 in a case where a sheet having a small separation discharge amount is made to pass. In the case where the separation discharge amount is small, influence from humidity is small, and therefore, each cleaning bias current is kept constant regardless of the humidity. In other words, the values in Table 1 are the standard output values.

Table 2 illustrated in FIG. 9 is a table corresponding to a case where a sheet having a large separation discharge amount is made to pass. As for a sheet contact area 5*p*, the potential V1 of the main brush 51 can be increased on a positive side by increasing cleaning bias current A12 on the positive side and reducing cleaning bias current A22 on a negative side as described above.

Figure 10:
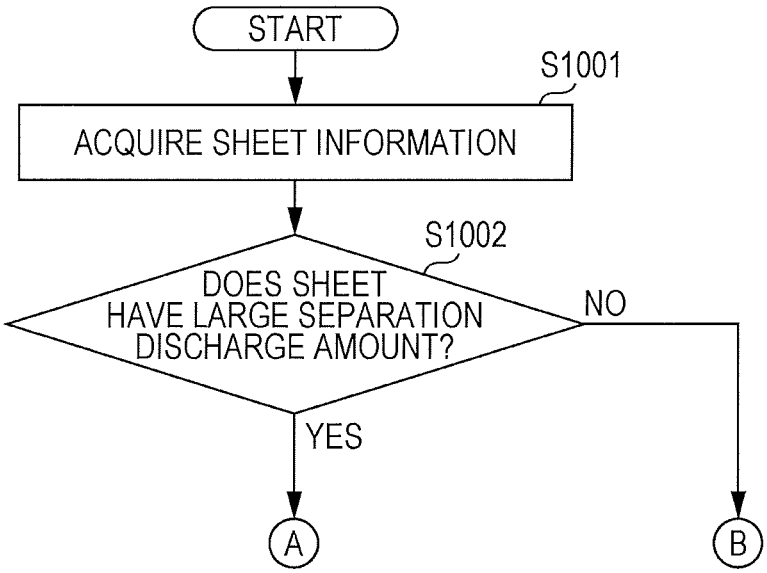
FIG. 10 is a flowchart illustrating operation of an image forming apparatus according to the second embodiment.
Figure 11:
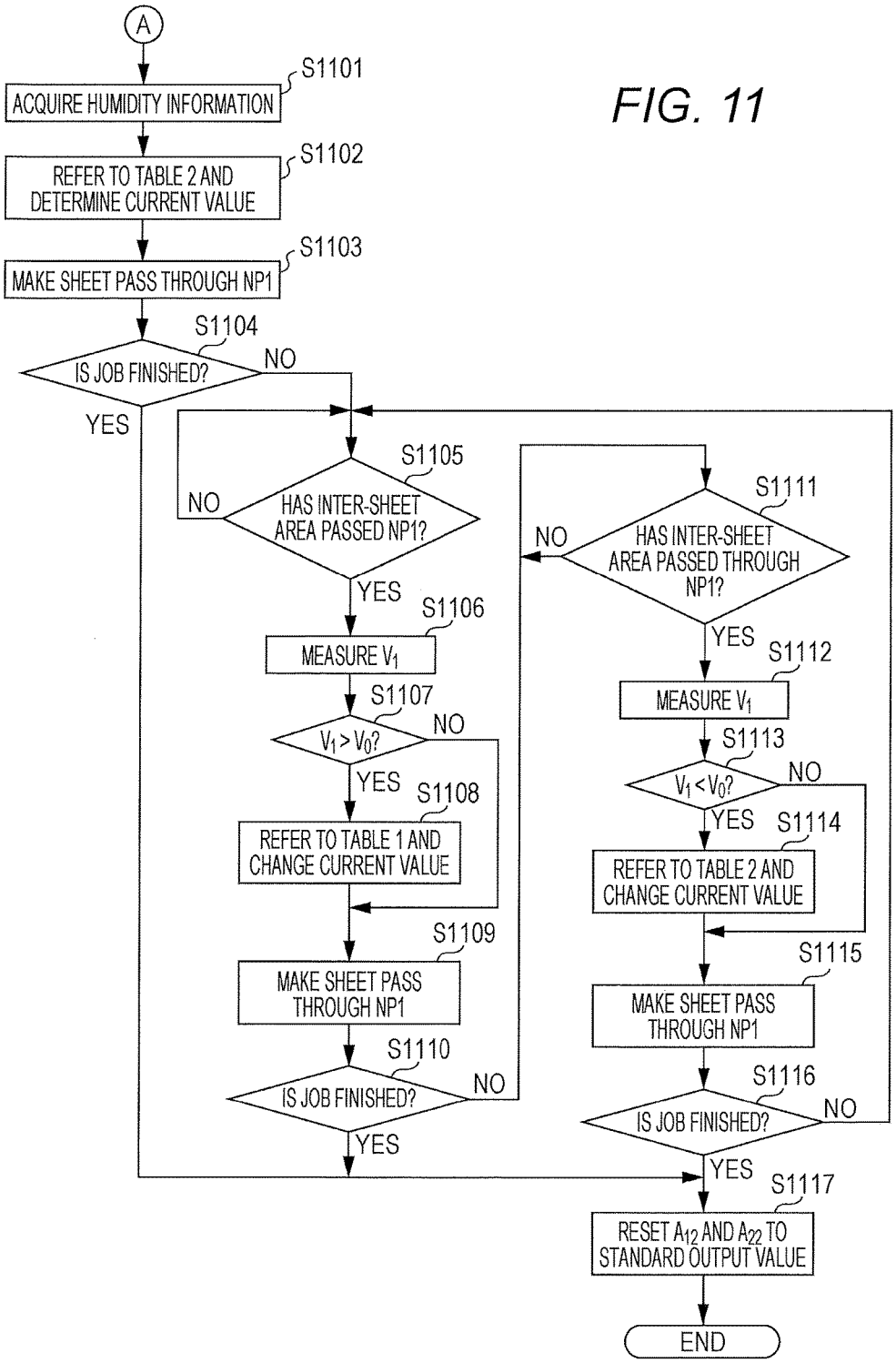
FIG. 11 is a flowchart illustrating operation of the image forming apparatus according to the second embodiment.
Figure 12:
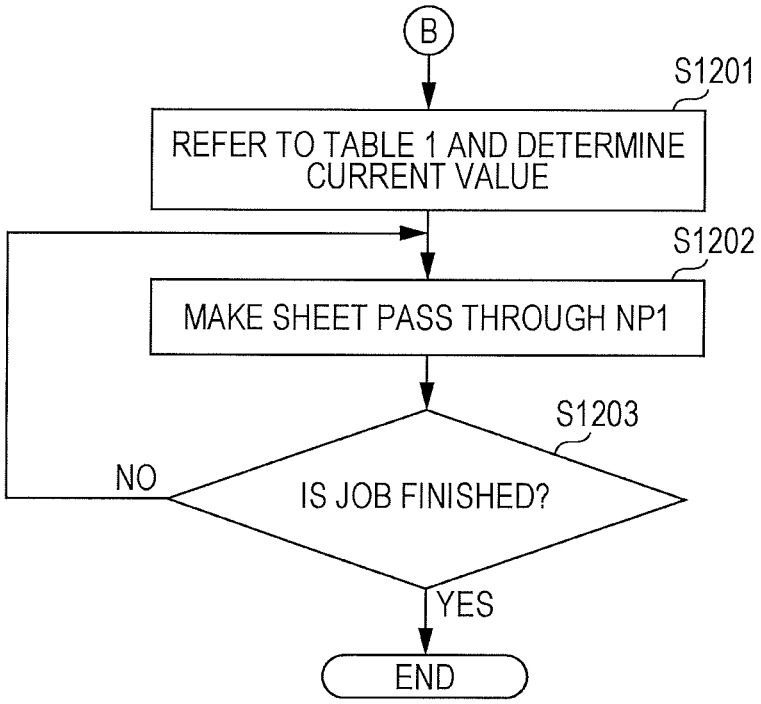
FIG. 12 is a flowchart illustrating operation of the image forming apparatus according to the second embodiment.

Next, operation of the image forming apparatus 100 according to the second embodiment will be described with reference to flowcharts in FIGS. 10 to 12. Note that the operation of the image forming apparatus 100 in FIGS. 10 to 12 is executed by cooperation of a control unit 190 and programs stored in a storage unit 182.

When a job is started, the control unit 190 acquires sheet information (step S1001). The sheet information represents information necessary to identify electrical characteristics of a passing sheet such as a type and thickness of a sheet, a basis weight, and the like. The control unit 190 selects a sheet stacked on a sheet feeding cassette 7 in accordance with a job input, and acquires information on the sheet stored in the storage unit 182.

In step S1002, the control unit 190 determines, on the basis of the sheet information acquired in step S1001, whether the sheet has a large separation discharge amount. In a case where the control unit 190 determines that the sheet has a large separation discharge amount (step S1002: Yes), processing proceeds to step S1101 in FIG. 11, and in a case of determining that the sheet does not have a large separation discharge amount (step S1002: No), the processing proceeds to step S1201 in FIG. 12.

Next, operation of the image forming apparatus 100 in the case where a sheet has a large separation discharge amount will be described with reference to the flowchart of FIG. 11.

In step S1101, the control unit 190 acquires humidity information as environmental information inside the image forming apparatus 100. The humidity information is detected by a humidity detection unit 170.

Subsequently, the control unit 190 refers to Table 2 and determines, for each of the sheet contact area 5*p* and the inter-sheet area 5*n*, a current value of cleaning bias current applied to each of the main brush 51 and the sub-brush 52 on the basis of the humidity information acquired in step S1101 (Step S1102).

Next, the control unit 190 makes a sheet pass through a main brush nip NP1 (step S1103), and determines whether the job is finished (step S1104). In a case where the control unit 190 determines that the job is finished (step S1104: Yes), the processing proceeds to step S1117, but in a case of determining that the job is not finished (step S1104: No), the processing proceeds to step S1105.

Since the processing in steps S1105 and S1106 is similar to processing in step S703 and step S704 in FIG. 7, a description thereof will be omitted.

In step S1107, the control unit 190 (determiner) determines whether potential V1 measured in step S1106 exceeds a predetermined threshold V0.

In a case where the control unit 190 determines that the potential V1 does not exceed the threshold V0, that is, V1≥V0 (step S1107: No), the processing proceeds to step S1109. In a case where the control unit 190 determines that the potential V1 exceeds the threshold V0, that is, when V1>V0 (step S1107: Yes) is satisfied, the processing proceeds to step S1108.

In step S1108, the control unit 190 (controller) refers to Table 1 and changes, for each of the sheet contact area 5*p* and the inter-sheet area 5*n*, the current value of the cleaning bias current applied to each of the main brush 51 and the sub-brush 52, and the processing proceeds to S1109.

Since the processing in steps S1109 to S1112 is similar to the processing in steps S1103 to S1106, a description thereof will be omitted.

In step S1113, the control unit 190 (determiner) determines whether the potential V1 measured in step S1112 is lower than the predetermined threshold V0.

In a case where the control unit 190 determines that the potential V1 is not lower than the threshold V0, that is, V1≥V0 (step S1113: No), the processing proceeds to step S1115. In a case where the control unit 190 determines that the potential V1 is lower than the threshold V0, that is, V1<V0 (step S1113: Yes), the processing proceeds to step S1114.

In step S1114, the control unit 190 (controller) refers to Table 2 and changes, for each of the sheet contact area 5*p* and the inter-sheet area 5*n*, the current value of the cleaning bias current applied to each of the main brush 51 and the sub-brush 52, and the processing proceeds to S1115.

In step S1115, the control unit 190 makes a sheet pass through the main brush nip NP1, and then determines whether the job is finished (step S1116). In a case where the control unit 190 determines that the job is finished (step S1116: Yes), the processing proceeds to step S1117, but in a case of determining that the job is not finished (step S1116: No), the processing returns to step S1105, and the above-described processing is repeated.

In step S1117, the control unit 190 resets the cleaning bias current A12 and A22 to the standard output values (values in Table 1) at the time of starting a job, and finishes the control.

Next, operation of the image forming apparatus 100 in a case where a sheet has a small separation discharge amount will be described with reference to the flowchart of FIG. 12.

In step S1201, the control unit 190 refers to Table 1 and determines, for each of the sheet contact area 5*p* and the inter-sheet area 5*n*, a current value of the cleaning bias current applied to each of the main brush 51 and the sub-brush 52. Next, the control unit 190 makes a sheet pass through the main brush nip NP1 (step S1202), and determines whether the job is finished (step S1203). In a case where the control unit 190 determines that the job is not finished (step S1203: No), the processing returns to step S1202, but in a case of determining that the job is finished (step S1203: Yes), the control is finished.

As described above, in the image forming apparatus 100 according to the second embodiment, the current values of the cleaning bias current applied to the main brush 51 and the sub-brush 52 are set different in each of the sheet contact area 5*p* and the inter-sheet area 5*n* on the basis of the sheet information. In other words, in the case where a sheet having a large separation discharge amount is made to pass, a current value of cleaning bias current is determined by referring to Table 2, and the current value of the cleaning bias current for the sheet contact area 5*p* is controlled so as to become larger than the current value in Table 1 on the positive side.

When control based on Table 2 is executed for a sheet having a small separation discharge amount, the sheet contact area 5*p* passing through the main brush nip portion NP1 comes to have a potential on the positive side, and a potential difference between the transfer belt 5 and the sub-brush 52 becomes large at a sub-brush nip NP2. Therefore, normal bias may not be applied, but cleaning can be normally performed by performing the above-described control.

Furthermore, in the image forming apparatus 100 according to the second embodiment, in a case where a sheet having a large separation discharge amount is made to pass, a current value of cleaning bias current applied to the sheet contact area is set different on the basis of the humidity information. In other words, the lower the humidity condition is, the larger the cleaning bias current is set on a polarity opposite to a normal charge polarity. As a result, the effect of the present invention can be sufficiently obtained under the low humidity condition in which the separation discharge amount is increased.

Furthermore, in the image forming apparatus 100 according to the second embodiment, in a case where a sheet having a large separation discharge amount is made to pass, the potential V1 of the main brush 51 is measured for each inter-sheet area 5*n*. Additionally, in a case where the potential V1 exceeds the threshold V0, the current value is changed to a current value in Table 1 so as to lower the potential V1 of the main brush 51. Furthermore, in a case where the potential V1 exceeds the threshold V0, the current value is changed to a current value in Table 2 again. With repetition of the above-described processing, the potential V1 of the main brush 51 can be controlled so as to constantly have a value close to the threshold V0, and bias of the transfer belt 5 can be kept constant as a result thereof, and therefore, transfer belt 5 can be stably cleaned.

Meanwhile, in the above embodiment, in the case where a sheet having a large separation discharge amount is made to pass, the potential V1 of the main brush 51 is measured for each inter-sheet area 5*n*, but not limited thereto. In the case of where a sheet having a large separation discharge amount is made to pass, only the current values in Table 2 may be utilized and the potential V1 may not be necessarily measured. In this case, a voltage measuring unit 51*c* becomes unnecessary, and therefore, the present invention can be implemented with a structure simpler the above-described embodiment.

Other Embodiments

While the present invention has been specifically described on the basis of the embodiments according to the present invention, note that the above-described embodiments are preferred examples and not limited thereto. A modification can be suitably made in a range without departing from the gist of the present invention.

For example, in the above-described embodiments, the cleaning bias current applied to the inter-sheet area 5*n* is kept constant, but strictly speaking, since voltage in a region on the inter-sheet area 5*n* where toner exists is needed to be kept constant, the cleaning bias current applied to a region on the inter-sheet area 5*n* where no toner exists can be suitably changed.

Additionally, in the above embodiment, the voltage measuring unit 51*c* measures voltage when the inter-sheet area 5*n* passes through the main brush nip NP1, but not limited thereto. The above-described control can also be performed by: measuring voltage when the sheet contact area 5*p* passes; and estimating whether a potential of the inter-sheet area 5*n* exceeds a predetermined threshold. Since control is thus performed on the basis of a potential measurement result when the sheet contact area 5*p* passes before the inter-sheet area 5*n* reaches the main brush nip portion NP1, the potential of the transfer belt 5 can be adjusted in an early stage.

Additionally, the detailed structure of each device constituting the image forming apparatus and detailed operation of each device can also be suitably changed in the range without departing from the gist of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning apparatus comprising:

a brush that contacts a transfer member and cleans and removes toner existing on the transfer member, the transfer member having a sheet contact area contacting a sheet on the transfer member and an inter-sheet area other than the sheet contact area on the transfer member;

a constant current type voltage applier that applies voltage to the brush; and a hardware processor that determines whether a condition that voltage applied to the brush exceeds a predetermined threshold when the inter-sheet area passes through a nip formed by the brush and the transfer member contacting each other is satisfied, and controls the voltage applied to the brush by changing bias current of the voltage applier, wherein in a case where the hardware processor determines that the condition that the voltage applied to the brush when the inter-sheet area passes through the nip exceeds the predetermined threshold is satisfied, the hardware processor changes the bias current when the sheet contact area passes through the nip.

2. The cleaning apparatus according to claim 1, further comprising a voltage measurer that measures voltage applied to the brush at the nip formed by the brush and the transfer member contacting each other, wherein the hardware processor determines whether the voltage measured by the voltage measurer exceeds the predetermined threshold.

3. The cleaning apparatus according to claim 2, wherein the voltage measurer measures the voltage when the inter-sheet area passes through the nip.

4. The cleaning apparatus according to claim 1, wherein the hardware processor changes the bias current when the sheet contact area passes through the nip.

5. The cleaning apparatus according to claim 1, wherein the hardware processor sets, on a polarity side opposite to a normal charge polarity, a value of the bias current when the sheet contact area passes through the nip larger than the bias current when the inter-sheet area passes the nip.

6. The cleaning apparatus according to claim 1, wherein the hardware processor changes the bias current when the sheet contact area passes through the nip on the basis of environmental information.

7. The cleaning apparatus according to claim 6, wherein the environmental information includes humidity information, and the lower the humidity is, the larger the hardware processor sets the bias current when the sheet contact area passes through the nip on the polarity side opposite to the normal charge polarity.

8. The cleaning apparatus according to claim 1, wherein the hardware processor does not change the bias current when the inter-sheet area passes the nip.

9. An image forming apparatus comprising:

an image bearer that carries a toner image to be transferred onto a sheet;

a transfer member that transfers the toner image formed on the image bearer onto a sheet; and the cleaning apparatus according to claim 1.

10. A non-transitory recording medium storing a computer readable program executed in a computer of an image forming apparatus that includes: an image bearer that carries a toner image to be transferred onto a sheet; a transfer member that transfers the toner image formed on the image bearer onto a sheet, the transfer member having a sheet contact area contacting a sheet on the transfer member and an inter-sheet area other than the sheet contact area on the transfer member; and a cleaning apparatus, and the cleaning apparatus including: a brush that is rotated while contacting the transfer member and cleans and removes toner existing on the transfer member; and a constant current type voltage applier that applies voltage to the brush, the voltage applied to the brush being controlled by changing bias current of the voltage applier, the program causing the computer to perform:

determining whether a condition that voltage applied to the brush exceeds a predetermined threshold when the inter-sheet area passes through a nip formed by the brush and the transfer member contacting each other is satisfied; and controlling, in a case where the determining determines that the condition that the voltage applied to the brush when the inter-sheet area passes through the nip exceeds the predetermined threshold is satisfied, such that the bias current of the voltage applier is changed when a sheet contact area contacting a sheet existing on the transfer member passes through the nip.

* * * * *